US007785532B2

(12) United States Patent
Crook

(10) Patent No.: US 7,785,532 B2
(45) Date of Patent: Aug. 31, 2010

(54) HYBRID CORROSION-RESISTANT NICKEL ALLOYS

(75) Inventor: Paul Crook, Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 627 days.

(21) Appl. No.: 11/803,353

(22) Filed: May 14, 2007

(65) Prior Publication Data

US 2008/0038148 A1 Feb. 14, 2008

Related U.S. Application Data

(60) Provisional application No. 60/836,609, filed on Aug. 9, 2006.

(51) Int. Cl.
*C22C 19/05* (2006.01)

(52) U.S. Cl. ..... 420/453; 420/443; 420/445; 148/427

(58) Field of Classification Search ..... 420/453, 420/443, 445; 148/427
See application file for complete search history.

(56) References Cited

U.S. PATENT DOCUMENTS

| | | | | |
|---|---|---|---|---|
| 1,710,445 | A | | 4/1929 | Becket |
| 1,836,317 | A | | 12/1931 | Franks |
| 3,203,792 | A | | 8/1965 | Scheil et al. |
| 3,838,981 | A | | 10/1974 | Foley et al. |
| 4,043,810 | A | | 8/1977 | Acuncius et al. |
| 4,129,464 | A | | 12/1978 | Matthews et al. |
| 4,245,698 | A | * | 1/1981 | Berkowitz et al. ..... 166/244.1 |
| 4,533,414 | A | | 8/1985 | Asphahani |
| 4,818,486 | A | | 4/1989 | Rothman et al. |
| 4,906,437 | A | | 3/1990 | Heubner et al. |
| 5,019,184 | A | | 5/1991 | Crum et al. |
| 5,374,323 | A | * | 12/1994 | Kuhlman et al. ..... 148/677 |
| 5,417,918 | A | | 5/1995 | Kohler et al. |
| 5,429,690 | A | | 7/1995 | Heubner et al. |
| 5,529,642 | A | | 6/1996 | Sugahara et al. |
| 6,280,540 | B1 | | 8/2001 | Crook |
| 6,503,345 | B1 | | 1/2003 | Klarstrom |
| 6,544,362 | B2 | * | 4/2003 | Pike et al. ..... 148/675 |
| 2003/0051783 | A1 | | 3/2003 | Pike, Jr. et al. |
| 2003/0070733 | A1 | | 4/2003 | Pike, Jr. et al. |
| 2003/0084975 | A1 | | 5/2003 | Pike et al. |
| 2003/0091460 | A1 | | 5/2003 | Klarstrom |
| 2005/0053513 | A1 | | 3/2005 | Pike, Jr. |

FOREIGN PATENT DOCUMENTS

| | | |
|---|---|---|
| EP | 0 365 884 B1 | 12/1993 |
| EP | 0 628 088 B1 | 4/1997 |
| GB | 869753 | 6/1961 |
| GB | 2 003 179 | 3/1979 |

* cited by examiner

*Primary Examiner*—Roy King
*Assistant Examiner*—Jessee R. Roe
(74) *Attorney, Agent, or Firm*—Buchanan Ingersoll & Rooney PC

(57) ABSTRACT

A nickel-molybdenum-chromium alloy, capable of withstanding both strong oxidizing and strong reducing 2.5% hydrochloric acid solutions at 121° C., contains 20.0 to 23.5 wt. % molybdenum and 13.0 to 16.5 wt. % chromium with the balance being nickel plus impurities and residuals of elements used for control of oxygen and sulfur.

7 Claims, 1 Drawing Sheet

HYBRID CORROSION-RESISTANT NICKEL ALLOYS

CROSS REFERENCE TO RELATED APPLICATION

This application claims the benefit of provisional application Ser. No. 60/836,609, filed Aug. 9, 2006.

FIELD OF INVENTION

The invention relates to corrosion-resistant, nickel-based alloys.

BACKGROUND OF THE INVENTION

In the nineteen twenties, it was discovered by Becket (U.S. Pat. No. 1,710,445) that the addition of 15 to 40 wt. % molybdenum to nickel resulted in alloys highly resistant to non-oxidizing acids, notably hydrochloric and sulfuric, two of the most important industrial chemicals. Since the least expensive source of molybdenum was ferro-molybdenum, a significant quantity of iron was included in these alloys. At about the same time, it was also discovered by Franks (U.S. Pat. No. 1,836,317) that nickel alloys containing significant quantities of molybdenum, chromium, and iron, could cope with an even wider range of corrosive chemicals. We now know that this is because chromium encourages the formation of protective (passive) films in so-called oxidizing acids (such as nitric), which induce cathodic reactions of high potential. These inventions led to the introduction of the cast HASTELLOY A, B, and C alloys, and subsequently to the wrought B, C, and C-276 alloys. The need to minimize the carbon and silicon contents of such alloys, to improve their thermal stability (Scheil, U.S. Pat. No. 3,203,792) was factored into the composition of HASTELLOY C-276 alloy.

With regard to the quantities of molybdenum and chromium that can be added to nickel, these are dependent upon thermal stability. Nickel itself possesses a face-centered cubic structure, at all temperatures below its melting point. Such a structure provides excellent ductility and resistance to stress corrosion cracking. Thus, it is desirable that alloys of nickel designed to resist corrosion also possess this structure, or phase. However, if the combined additions exceed their limit of solubility in nickel, second phases of a less-desirable nature are possible. Metastable or supersaturated nickel alloys are possible if high temperature annealing (to dissolve unwanted second phases), followed by rapid quenching (to lock in the high temperature structure) are employed. The Ni—Mo alloys and most of the Ni—Cr—Mo alloys fall into this category. The main concern with such alloys is their propensity to form second phase precipitates, particularly at microstructural imperfections such a grain boundaries, when reheated to temperatures in excess of about 500° C., where diffusion becomes appreciable. Such elevated temperature excursions are common during welding. The term thermal stability relates to the propensity for second phase precipitation at elevated temperatures.

In the nineteen fifties, Ni—Mo and Ni—Cr—Mo alloys with low iron contents, covered by G.B. Patent 869,753 (Junker and Scherzer) were introduced, with narrower compositional ranges and stricter controls on carbon and silicon, to ensure corrosion resistance yet minimize thermal instability. The molybdenum range of the nickel-molybdenum (Ni—Mo) alloys was 19 to 32 wt. %, and the molybdenum and chromium ranges of the nickel-chromium-molybdenum (Ni—Cr—Mo) alloys were 10 to 19 wt. % and 10 to 18 wt. %, respectively. These led to the introduction of wrought HASTELLOY B-2 and C-4 alloys in the nineteen seventies.

Since then, it has been discovered that HASTELLOY B-2 alloy is prone to rapid, deleterious phase transformations during welding. To remedy this, HASTELLOY B-3 alloy, the phase transformations of which are much slower, was introduced in the nineteen nineties after discoveries by Klarstrom (U.S. Pat. No. 6,503,345). With regard to recent developments in the field of Ni—Cr—Mo alloys, these include HASTELLOY C-22 alloy (Asphahani, U.S. Pat. No. 4,533,414), HASTELLOY C-2000 alloy (Crook, U.S. Pat. No. 6,280,540), NICROFER 5923 hMo (Heubner, Köhler, Rockel, and Wallis, U.S. Pat. No. 4,906,437), and INCONEL 686 alloy (Crum, Poole, and Hibner, U.S. Pat. No. 5,019,184). These newer alloys require molybdenum within the approximate range 13 to 18 wt. %, and chromium within the approximate range 19 to 24.5 wt. %.

With a view to enhancing the corrosion performance of the Ni—Cr—Mo alloys, additions of tantalum (of the so-called reactive element series) have been used. Notably, U.S. Pat. No. 5,529,642 describes an alloy containing from 1.1 to 8 wt. % tantalum. This has been commercialized as MAT-21 alloy.

Although the Ni—Mo alloys possess outstanding resistance to non-oxidizing acids (i.e. those which induce the evolution of hydrogen at cathodic sites), they are intolerant of additions, residuals, or impurities which result in cathodic reactions of higher potential. One of these so-called "oxidizing species" is oxygen, which is hard to avoid. While the Ni—Cr—Mo alloys can tolerate such species, they do not possess sufficient resistance to the non-oxidizing acids for many applications. Thus there is a need for materials which possess the attributes of both the Ni—Mo and Ni—Cr—Mo alloys.

Materials with compositions between those of the Ni—Mo and Ni—Cr—Mo alloys do exist. For example, a Ni—Mo—Cr alloy containing approximately 25 wt. % molybdenum and 8 wt. % chromium (242 alloy, U.S. Pat. No. 4,818,486) was developed for use at high temperatures in gas turbines, but has been used to resist aqueous environments involving hydrofluoric acid. Also, B-10 alloy, a nickel-based material containing about 24 wt. % molybdenum, 8 wt. % chromium, and 6 wt. % iron was promoted as being tolerant of oxidizing species in strong non-oxidizing acids. As will be shown, however, the properties of these two Ni—Mo—Cr alloys are generally similar to those of the Ni—Mo alloys, and do not provide the desired versatility.

SUMMARY OF THE INVENTION

The principal object of this invention is to provide wrought alloys which exhibit characteristics of both the Ni—Mo and Ni—Cr—Mo alloys, possess good thermal stability, and are thus extremely versatile. These highly desirable properties have been unexpectedly attained using a nickel base, molybdenum between 20.0 and 23.5 wt. %, and chromium between 13.0 and 16.5 wt. %. To enable the removal of oxygen and sulfur during the melting process, such alloys typically contain small quantities of aluminum and manganese (up to about 0.5 and 1 wt. %, respectively, in the Ni—Cr—Mo alloys), and possibly traces of magnesium and rare earth elements (up to about 0.05 wt. %).

Iron is the most likely impurity in such alloys, due to contamination from other nickel alloys melted in the same furnaces, and maxima of 2.0 wt. % or 3.0 wt. % are typical of those Ni—Cr—Mo alloys that do not require an iron addition.

TABLE 1

Nominal Compositions of Alloys in FIG. 1, Weight %

| | Alloy | | | | | | | | | | |
|---|---|---|---|---|---|---|---|---|---|---|---|
| | Ni | Mo | Cr | Fe | W | Cu | Mn | Al | Si | C | Other |
| HYBRID | BAL. | 22 | 15 | — | — | — | 0.3 | 0.3 | — | — | — |
| B-3 | 65** | 28.5 | 1.5 | 1.5 | 3* | 0.2* | 3* | 0.5* | 0.1* | 0.01* | — |
| B-10 | 62 | 24 | 8 | 6 | — | 0.5* | 1* | — | 0.1* | 0.01* | — |
| 242 | 65 | 25 | 8 | 2* | — | 0.5* | 0.8* | 0.5* | 0.8* | 0.03* | Co 1* |
| C-22 | 56 | 13 | 22 | 3 | 3 | 0.5* | 0.5* | — | 0.08* | 0.01* | V 0.35* |
| C-276 | 57 | 16 | 16 | 5 | 4 | 0.5* | 1* | — | 0.08* | 0.01* | V 0.35* |
| C-2000 | 59 | 16 | 23 | 3* | — | 1.6 | 0.5* | 0.5* | 0.08* | 0.01* | — |

*Maximum,
**Minimum

Thus a maximum of 2.0 wt. % iron is proposed for the alloys of this invention. Other metallic impurities are possible, including, tungsten (up to 0.75 wt. %), cobalt (up to 1.0 wt. %), copper (up to 0.5 wt. %), titanium (up to 0.2 wt. %), niobium (up to 0.5 wt. %), tantalum (up to 0.2 wt. %), and vanadium (up to 0.2 wt. %).

By use of special melting techniques, in particular argon-oxygen decarburization, it is possible to achieve very low carbon and silicon contents in such alloys, to enhance their thermal stability. However, it is not possible to exclude these elements completely.

With regard to carbon content, the preferred experimental alloy of the study which led to this discovery contained 0.013 wt. % carbon (because it was not possible to apply the argon-oxygen decarburization process during melting of the experimental alloys). Thus it is evident that at least 0.013 wt. % carbon can be tolerated in the alloys of this invention. This is therefore the proposed maximum for carbon in the alloys of this invention.

With regard to silicon, a maximum of 0.08 wt. % is typical of the wrought Ni—Cr—Mo alloys; thus a maximum of 0.08 wt. % is proposed for the alloys of this invention.

DETAILED DESCRIPTION OF THE PREFERRED EMBODIMENT

Figure 1:
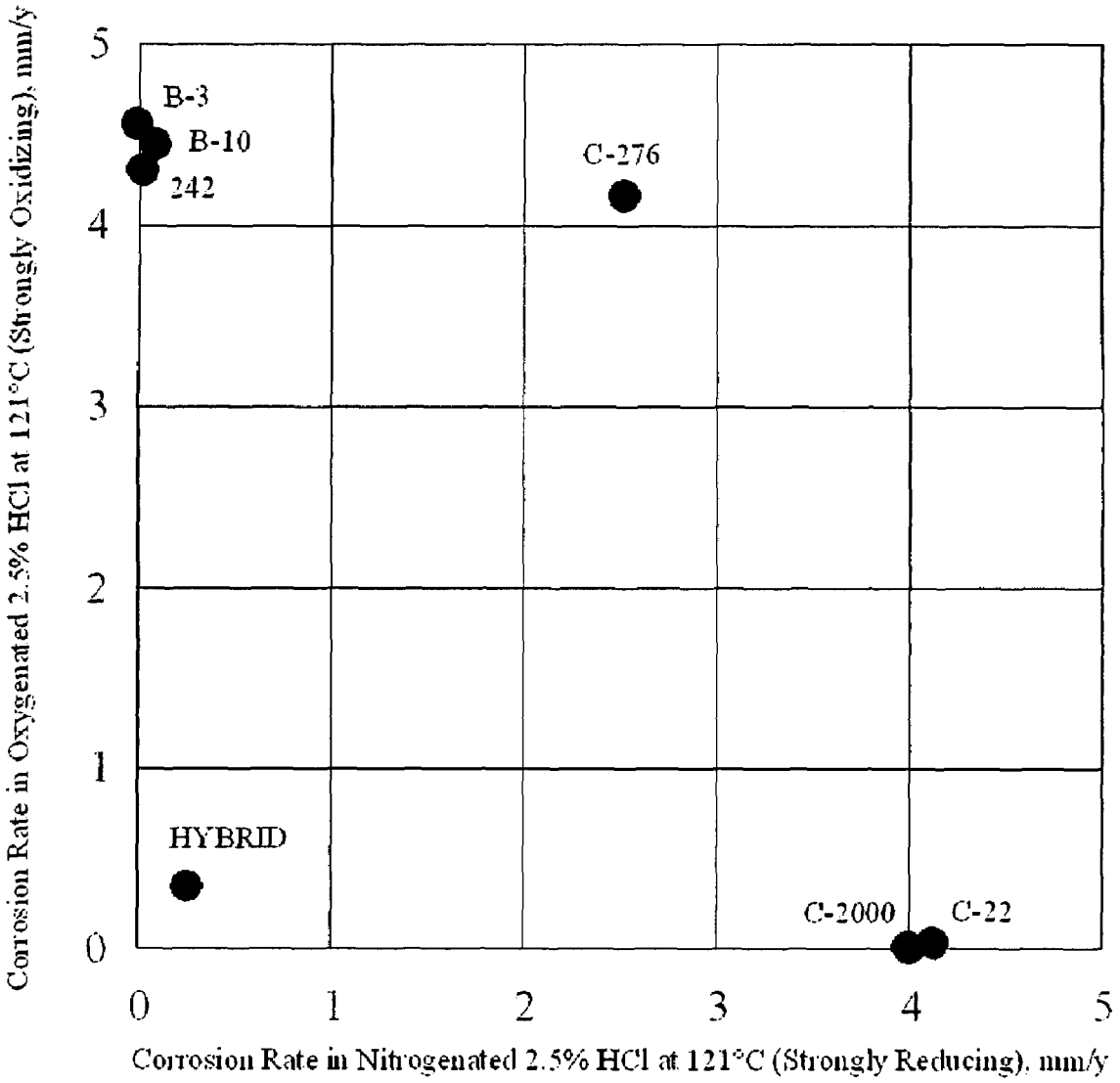
FIG. 1 is a chart showing the corrosion characteristics of certain prior art alloys and the alloys of this invention.

It is believed that the extreme versatility of the alloys of this invention is best illustrated by FIG. 1, a plot of corrosion rates in a strong, oxidizing acid solution versus corrosion rates in a strong, non-oxidizing (reducing) acid solution. B-3, B-10, 242, C-22, C-276, and C-2000 are commercially available, wrought, Ni—Mo, Ni—Mo—Cr, and Ni—Cr—Mo alloys, the compositions of which are given in Table 1. The HYBRID alloy is the preferred composition of this invention. Of these materials, only the HYBRID alloy provides sufficient resistance to both the strong, oxidizing and strong, non-oxidizing acid environments to be useful. Other commercially available, wrought Ni—Cr—Mo alloys (C-4, MAT-21, 59, and 686 alloys) behaved like the C-type alloys shown in FIG. 1, but were off-scale (see the test results in Table 4).

DETAILED DESCRIPTION OF THE INVENTION

The discovery of these extremely versatile alloys involved the testing of small, experimental heats of material (each about 22.7 kg in weight). These were produced by vacuum induction melting, electroslag remelting, ingot homogenizing (50 h at 1232° C.), hot forging, and hot rolling into 3.2 mm thick sheets at 1149 to 1177° C. For each experimental alloy, an appropriate solution annealing treatment (in most cases at 1149° C.) was determined by furnace trials. As may be deduced from Tables 2 and 3 (nominal compositions and chemical analyses of experimental alloys), deliberate additions of manganese and aluminum were used to help minimize the sulfur and oxygen contents of all the alloys. Except in the case of the HYBRID alloy, the experimental materials also contained traces of rare earth elements, for enhanced sulfur and oxygen control.

The upper compositional boundaries were determined without corrosion testing, since it was not possible to generate a single phase microstructure in alloy EN1406. Thus, 23.67 wt. % molybdenum and 16.85 wt. % chromium are regarded as outside the compositional range of this invention.

TABLE 2

Nominal Compositions of Experimental Alloys, Weight %

| | ALLOY | | | | |
|---|---|---|---|---|---|
| | Ni | Mo | Cr | Mn | Al |
| HYBRID | BAL. | 22 | 15 | 0.3 | 0.3 |
| EN1006 | BAL. | 20 | 15 | 0.3 | 0.3 |
| EN1106 | BAL. | 23 | 15 | 0.3 | 0.3 |
| EN1206 | BAL. | 22 | 14 | 0.3 | 0.3 |
| EN1306 | BAL. | 22 | 16 | 0.3 | 0.3 |
| EN1406 | BAL. | 24 | 17 | 0.3 | 0.3 |
| EN5900* | BAL. | 23 | 13 | 0.4 | 0.2 |

*Nominal composition also included 1 wt. % iron

TABLE 3

Chemical Analyses of Experimental Alloys (Prior to Electroslag Remelting), Weight %

| | ALLOY | | | | | | | | | |
|---|---|---|---|---|---|---|---|---|---|---|
| | Ni | Mo | Cr | Mn | Al | C | Si | Fe | Ce | La |
| HYBRID* | 63.34 | 21.64 | 14.93 | 0.27 | 0.25 | 0.013 | 0.02 | 0.07 | — | — |
| EN1006 | 64.82 | 19.82 | 14.56 | 0.22 | 0.26 | 0.008 | 0.04 | 0.22 | 0.012 | 0.011 |
| EN1106* | 61.21 | 23.06 | 14.86 | 0.27 | 0.27 | 0.005 | 0.05 | 0.06 | 0.023 | 0.019 |
| EN1206* | 63.73 | 21.63 | 13.77 | 0.27 | 0.31 | 0.005 | 0.04 | 0.05 | 0.017 | 0.012 |
| EN1306* | 62.01 | 21.46 | 15.60 | 0.26 | 0.27 | 0.004 | 0.05 | 0.06 | 0.013 | 0.010 |
| EN1406 | 58.58 | 23.67 | 16.85 | 0.26 | 0.26 | 0.004 | 0.04 | 0.15 | 0.012 | 0.008 |
| EN5900 | 62.29 | 22.60 | 12.67 | 0.35 | 0.23 | 0.010 | 0.03 | 1.19 | 0.022 | — |

*Alloys of this invention

The corrosion rates for the other experimental alloys (i.e. those which responded well to solution annealing and water quenching, yielding a single phase microstructure) and commercial materials in the strong, oxidizing and strong, reducing acid media previously mentioned are given in Table 4. The steep decline in resistance to the strong, oxidizing solution (oxygenated 2.5% HCl at 121° C.) associated with reducing the chromium content from 14.86 to 12.67 wt. % in alloys containing about 23 wt. % molybdenum (EN1106 versus EN5900) indicates that the chromium content should be at least 13.0 wt. %. Also, the steep decline in resistance to the strong, reducing solution (nitrogenated 2.5% HCl at 121° C.) associated with reducing the molybdenum content from 21.64 to 19.82 wt. % in alloys containing about 15 wt. % chromium (the HYBRID alloy versus EN1006) indicates that the molybdenum content should be at least 20.0 wt. %.

TABLE 4

Corrosion Rates (mm/y) for Experimental Alloys and Prior Art Alloys in Strong Oxidizing and Strong Reducing Acid Solutions

| ALLOY | OXYGENATED 2.5% HCl at 121° C. | NITROGENATED 2.5% HCl at 121° C. |
|---|---|---|
| HYBRID* | 0.37 | 0.27 |
| EN1006 | 0.41 | 0.93 |
| EN1106* | 0.40 | 0.23 |
| EN1206* | 0.54 | 0.46 |
| EN1306* | 0.31 | 0.53 |
| EN5900 | 1.22 | 0.13 |
| B-3 | 4.58 | <0.01 |
| B-10 | 4.45 | 0.09 |
| 242 | 4.31 | 0.04 |
| C-4 | 16.52 | 8.75 |
| C-22 | 0.02 | 4.13 |
| C-276 | 4.17 | 2.52 |
| C-2000 | 0.02 | 3.99 |
| 59 | 0.08 | 5.65 |
| 686 | 8.93 | 8.23 |
| MAT-21 | 1.27 | 5.98 |

*Alloys of this invention

To provide additional evidence of the unique behavior and versatility of the HYBRID alloy, it was compared with B-3 alloy (as the representative of the Ni—Mo system) and C-276 alloy (as the representative of the Ni—Cr—Mo system) in several other oxidizing and reducing environments. The results of these comparative tests are given in Table 5. In hydrochloric acid (HCl), hydrofluoric acid (HF), and sulfuric acid ($H_2SO_4$), which are reducing, the HYBRID alloy provides resistance approaching that of the Ni—Mo alloys. In nitric acid ($HNO_3$) and a mixture of ferric chloride ($FeCl_3$) plus hydrochloric acid, which is oxidizing, the HYBRID alloy approaches the performance of the Ni—Cr—Mo alloys, whereas the Ni—Mo alloys exhibit extremely high corrosion rates in such environments.

TABLE 5

Corrosion Rates (mm/y) of the HYBRID Alloy, B-3 Alloy, and C-276 alloy in other Environments

| CHEMICAL | CONC., wt. % | TEMP., ° C. | HYBRID ALLOY | B-3 ALLOY | C-276 ALLOY |
|---|---|---|---|---|---|
| HCl | 5 | 93 | 0.40 | 0.30 | 2.14 |
| HCl | 10 | 79 | 0.43 | 0.29 | 1.18 |
| HCl | 20 | 66 | 0.30 | 0.21 | 0.55 |
| HF | 20 | 66 | 0.58 | 0.66 | 0.84 |
| $H_2SO_4$ | 30 | 93 | 0.08 | 0.09 | 0.42 |
| $H_2SO_4$ | 50 | 93 | 0.06 | 0.04 | 0.62 |
| $H_2SO_4$ | 70 | 93 | 0.04 | 0.01 | 0.50 |
| $HNO_3$ | 10 | 93 | 0.10 | 1,440.57 | 0.07 |
| $FeCl_3$ + HCl | 6 + 1 | 120 | 0.26 | 47.69 | 0.12 |

Even though the samples tested were all wrought sheets, the alloys should exhibit comparable properties in other wrought forms (such as plates, bars, tubes, pipes, forgings, and wires) and in cast and powder metallurgy forms. Consequently, the present invention encompasses all forms of the alloy composition.

Although I have disclosed certain present preferred embodiments of the alloys, it should be distinctly understood that the present invention is not limited thereto but may be variously embodied within the scope of the following claims.

What is claimed is:

1. A nickel-molybdenum-chromium alloy, capable of withstanding both strong oxidizing and strong reducing 2.5% hydrochloric acid solutions at 121° C., consisting essentially of:

| | |
|---|---|
| molybdenum | 20.0 to 23.5 wt. % |
| chromium | 13.0 to 16.5 wt. % |
| aluminum | up to 0.5 wt. % |
| manganese | up to 1 wt. % |
| magnesium | up to 0.05 wt. % |
| rare earth elements | up to 0.05 wt. % |
| iron | up to 2.0 wt. % |
| silicon | up to 0.08 wt. % |
| carbon | up to 0.013 wt. % |
| tungsten | up to 0.75 wt. % |
| cobalt | up to 1.0 wt. % |
| copper | up to 0.5 wt. % |
| titanium | up to 0.2 wt. % |
| niobium | up to 0.5 wt. % |

-continued

| | |
|---|---|
| tantalum | up to 0.2 wt. % |
| vanadium | up to 0.2 wt. % |
| nickel | balance. |

2. The nickel-molybdenum-chromium alloy of claim 1 wherein the alloy is in a wrought form selected from the group consisting of sheets, plates, bars, tubes, pipes, forgings, and wires.

3. The nickel-molybdenum-chromium alloy of claim 1 wherein the alloy is in cast form.

4. The nickel-molybdenum-chromium alloy of claim 1 wherein the alloy is in powder metallurgy form.

5. A nickel-molybdenum-chromium alloy capable of withstanding both strong oxidizing and strong reducing 2.5% hydrochloric acid solutions at 121° C. consisting of:

| | |
|---|---|
| molybdenum | 21.46 to 23.06 wt. % |
| chromium | 13.77 to 15.60 wt. % |
| manganese | about 0.3 wt. % |
| aluminum | about 0.3 wt. % |

the balance being nickel plus impurities and residuals of elements used for control of oxygen and sulfur.

6. The nickel-molybdenum-chromium alloy of claim 5 wherein the impurities and residuals consist of:

| | |
|---|---|
| magnesium | up to 0.05 wt. % |
| rare earth elements | up to 0.05 wt. % |
| iron | up to 2.0 wt. % |

-continued

| | |
|---|---|
| silicon | up to 0.08 wt. % |
| carbon | up to 0.013 wt. % |
| tungsten | up to 0.75 wt. % |
| cobalt | up to 1.0 wt. % |
| copper | up to 0.5 wt. % |
| titanium | up to 0.2 wt. % |
| niobium | up to 0.5 wt. % |
| tantalum | up to 0.2 wt. % |
| vanadium | up to 0.2 wt. %. |

7. A nickel-molybdenum-chromium alloy, capable of withstanding both strong oxidizing and strong reducing 2.5% hydrochloric acid solutions at 121° C., consisting essentially of:

| | |
|---|---|
| molybdenum | 21.46 to 23.06 wt. % |
| chromium | 13.0 to 16.5 wt. % |
| aluminum | up to 0.5 wt. % |
| manganese | up to 1 wt. % |
| magnesium | up to 0.05 wt. % |
| rare earth elements | up to 0.05 wt. % |
| iron | up to 2.0 wt. % |
| silicon | up to 0.08 wt. % |
| carbon | up to 0.013 wt. % |
| tungsten | up to 0.75 wt. % |
| cobalt | up to 1.0 wt. % |
| copper | up to 0.5 wt. % |
| titanium | up to 0.2 wt. % |
| niobium | up to 0.5 wt. % |
| tantalum | up to 0.2 wt. % |
| vanadium | up to 0.2 wt. % |
| nickel | balance |

* * * * *